US005331698A

United States Patent [19]

Newkirk et al.

[11] Patent Number: 5,331,698

[45] Date of Patent: Jul. 26, 1994

[54] MATTRESS FOR BIRTHING BED

[75] Inventors: David C. Newkirk, Fairfield, Ohio; Sandy M. Richards, Centerville, Ind.; Richard L. Borders, Cincinnati, Ohio

[73] Assignee: Hill-Rom Company, Inc., Batesville, Ind.

[21] Appl. No.: 2,695

[22] Filed: Jan. 11, 1993

Related U.S. Application Data

[63] Continuation of Ser. No. 767,468, Sep. 30, 1991, abandoned.

[51] Int. Cl.[5] ..... A47C 27/18

[52] U.S. Cl. ..... 5/602; 5/455

[58] Field of Search ..... 5/449, 453, 455, 602, 5/644, 653

[56] References Cited

U.S. PATENT DOCUMENTS

| | | | |
|---|---|---|---|
| 2,819,712 | 1/1958 | Morrison | 5/453 |
| 2,822,554 | 2/1958 | Wenzelberger | 5/441 |
| 3,222,694 | 12/1965 | Schick | 5/653 |
| 3,298,044 | 1/1967 | Saltness et al. | 5/644 |
| 3,595,223 | 7/1971 | Castagna | 5/453 |
| 4,139,917 | 2/1979 | Fenwick | 5/602 |
| 4,247,091 | 11/1981 | Glowacki et al. | 5/66 |
| 4,277,859 | 7/1981 | Seaman | 5/644 |
| 4,356,578 | 11/1982 | Clark | 5/602 |
| 4,415,203 | 11/1983 | Cawley | 5/441 |
| 4,518,200 | 5/1985 | Armstrong | 297/DIG. 3 |
| 4,624,877 | 11/1986 | Lea et al. . | |
| 4,789,202 | 12/1988 | Alter | 297/DIG. 3 |
| 4,803,744 | 12/1989 | Peck et al. . | |
| 4,894,876 | 1/1990 | Fenwick | 5/60 |
| 4,947,500 | 8/1990 | Seiler | 5/455 |
| 5,020,176 | 6/1991 | Dotson | 5/455 |
| 5,068,933 | 12/1991 | Sexton | 5/441 |

FOREIGN PATENT DOCUMENTS

| | | |
|---|---|---|
| 8000655 | 4/1980 | PCT Int'l Appl. . |
| 903336 | 8/1962 | United Kingdom . |

*Primary Examiner*—Michael Milano

*Attorney, Agent, or Firm*—Wood, Herron & Evans

[57] ABSTRACT

A mattress for a birthing bed has three bladders inserted within a foam slab. A lumbar bladder and upper back bladder are on the birthing bed head panel and are attached at their borders to the foam mattress to promote uniform inflation. A seat bladder firms the seat when it is necessary for patient treatment procedures.

11 Claims, 3 Drawing Sheets

MATTRESS FOR BIRTHING BED

This application is a continuation of application Ser. No. 07/767,468 now abandoned filed Sep. 30, 1991.

SUMMARY OF THE INVENTION

This invention relates to a mattress for a birthing bed.

The birthing bed to which the invention relates has a base, a main frame and a patient support surface which is covered by mattress sections. The patient support surface has a seat panel, a head panel pivoted with respect to one side of the seat panel and a foot section which can be raised, lowered or removed with respect to the other edge of the seat panel.

The birthing bed is well suited to provide several functions relating to the birth of a child. It is designed for the patient's comfort; it is designed to maximize a patient's ability to further the labor process; and it is designed to assist the mother and gynecologist in the delivery process as well as post-delivery procedures.

An objective of the present invention has been to provide a mattress for such a birthing bed that better contributes to the functions referred to than have conventional mattresses.

This objective of the present invention has been attained by providing a foam mattress having inserted therein selectively inflatable bladders sandwiched between plies of foam. More specifically, the invention contemplates the provision of at least a lumbar bladder and preferably, in addition, an upper back inflatable bladder, these bladders being adhesively secured around their perimeter to the foam mattress. Preferably, the border of each bladder is about two inches in width and that two inches of width is adhesively secured to the foam. The advantage of this feature of the invention is that the bladders, when inflated with a patient lying upon them, will inflate uniformly transversely across the bladder. This is in contrast to prior art bladders which have simply been inserted into a mattress without being adhesively secured at their borders to the foam mattress. Such bladders will tend to inflate first in the area unpressed by the patient, thus creating an uncomfortable bulge at the side of the patient, the bladder being gradually filled in under the patient as the inflation process continues.

The objective of the invention is further attained by providing a bladder across the seat panel, the bladder preferably being of the type disclosed in U.S. Pat. No. 4,624,877 and consisting of a foam core surrounded by air-impervious sheet material. The function of the bladder is to inflate and make quite firm the seat portion of the bed to make more accessible the patient's body for episiotomy repair and birthing.

BRIEF DESCRIPTION OF THE DRAWINGS

The objectives and features of the present invention will become more readily apparent from the following detailed description taken in conjunction with the accompanying drawings in which.

DETAILED DESCRIPTION OF THE INVENTION

Figure 1:
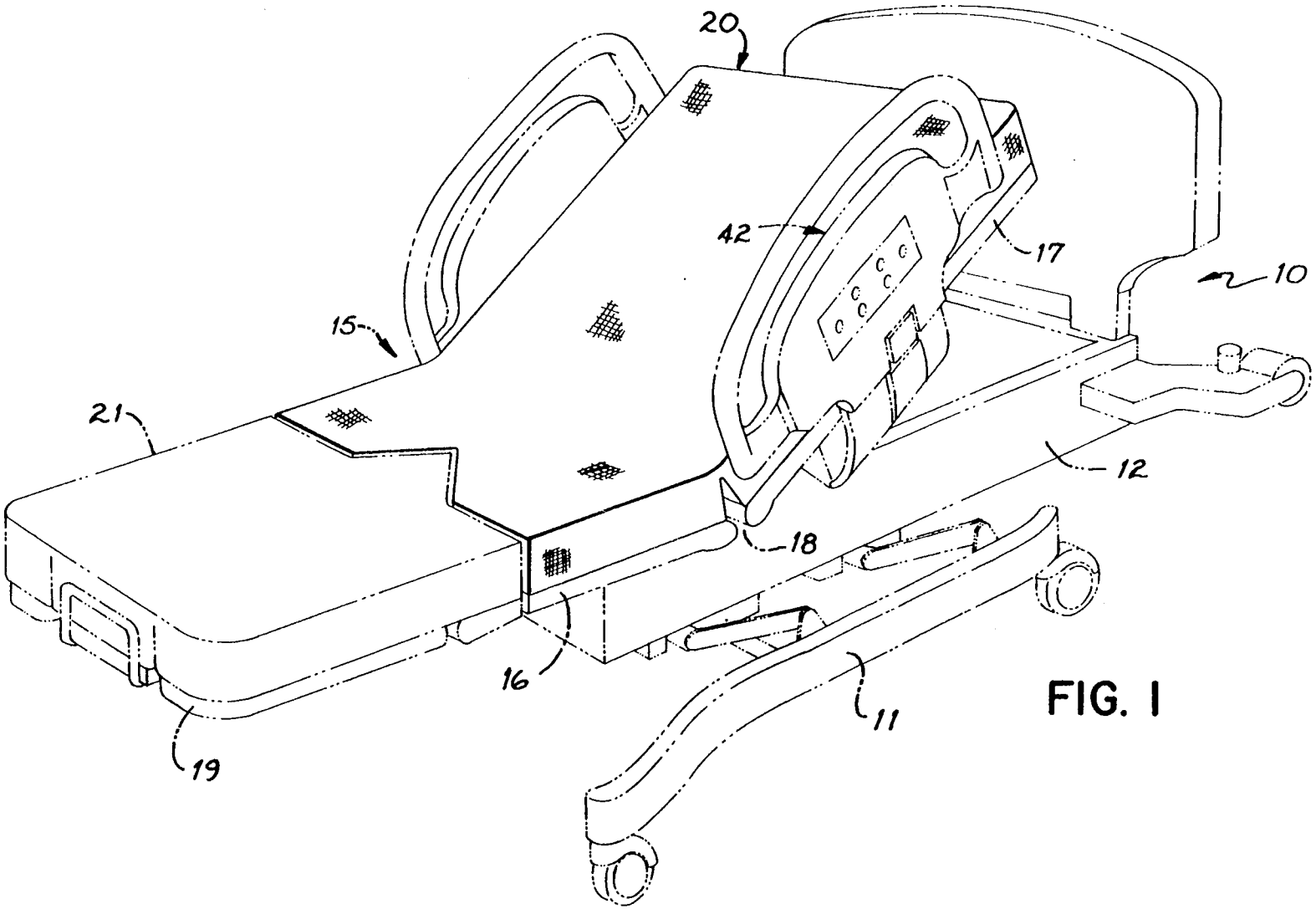
FIG. 1 is a perspective view of the birthing bed to which the invention relates.

Referring to FIG. 1, a birthing bed 10 is shown having a base 11 and a main frame 12. A patient support 15 is mounted on the main frame 12. The patient support includes a seat panel 16 and a head panel 17 hinged to the frame 12 at 18 at one edge of the seat panel. A footrest 19 is mounted on the frame 12 by structure which permits the footrest to be lowered from the position shown in FIG. 1 or to be removed altogether.

Figure 2:
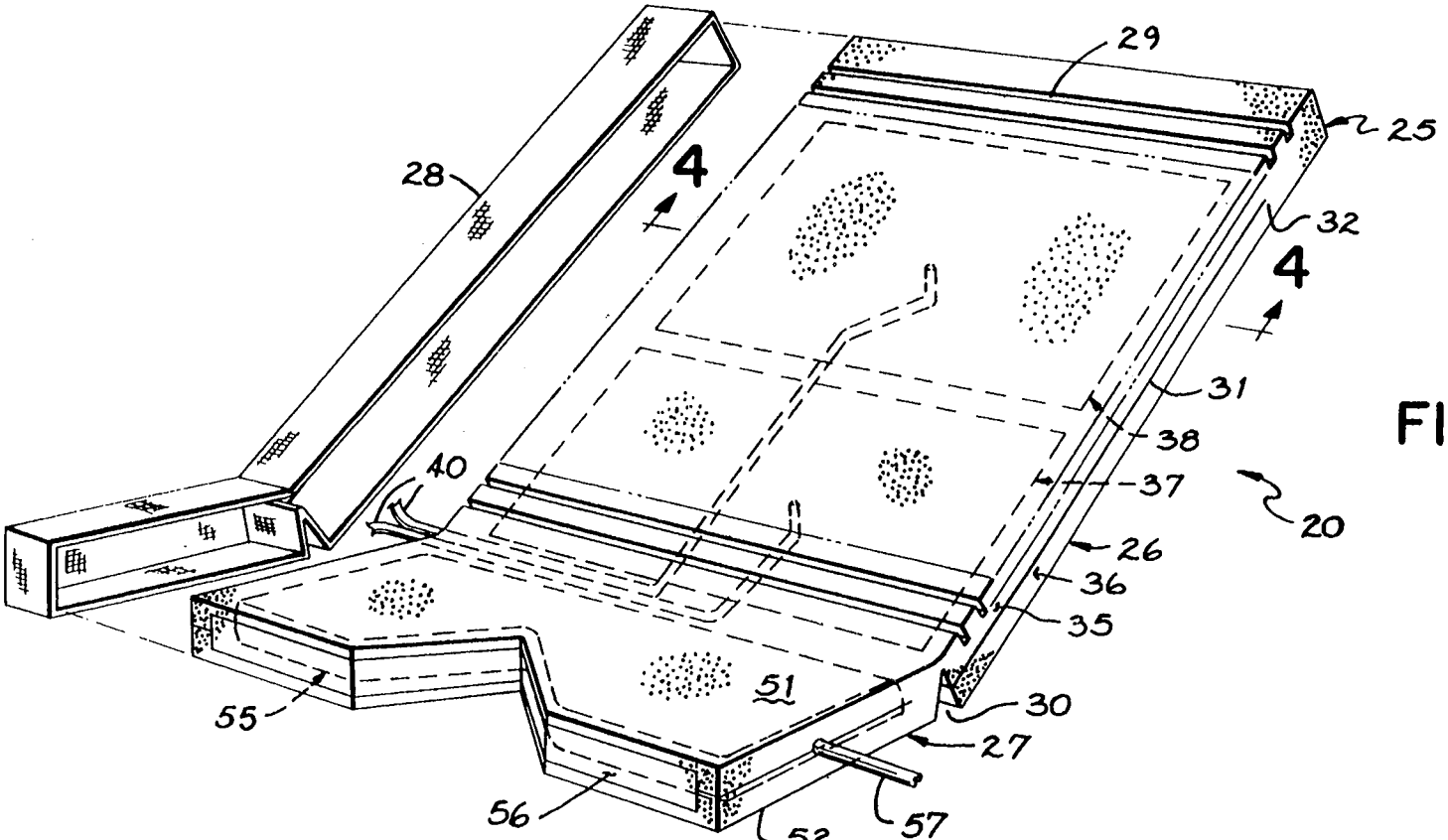
FIG. 2 is a diagrammatic perspective view of the present invention.

The body support panels 16, 17 and 19 are covered by a head end mattress section 20 and a footrest mattress section 21. The present invention addresses only the head end mattress section 20. Referring to FIG. 2, the mattress 20 is formed principally of conventional mattress foam which is a soft polyurethane foam slab indicated at 25. The foam slab 25 is in two sections 26 and 27 for the head panel and seat panel, respectively. The mattress slab 25 has a notch 30 that divides the sections 26 and 27 from each other. The sections are encased in a fabric mattress cover 28 having a zipper so that it can be removed for cleaning or replacement.

The foam section 26 preferably has transverse slots 29 formed in its upper surface to increase the softness that the patient perceives as she lies on the mattress. The section 26 is centrally sliced at 31 from the notch 30 to a line 32 adjacent the head end of the mattress section. The slicing 31 creates upper and lower plies 35 and 36 each of which is about 2 inches thick. A lumbar bladder 37 and an upper back bladder 38 are inserted between the two plies. Each bladder has a tube 40 by which the bladders are inflated. As shown in FIG. 2, the respective tubes 40 extend between the two plies to the notch 30 and then exit transversely out of the mattress where they are connected to a pump having suitable controls for their inflation. The controls may be mounted on an armrest panel 42 as shown in FIG. 1.

Figure 4:
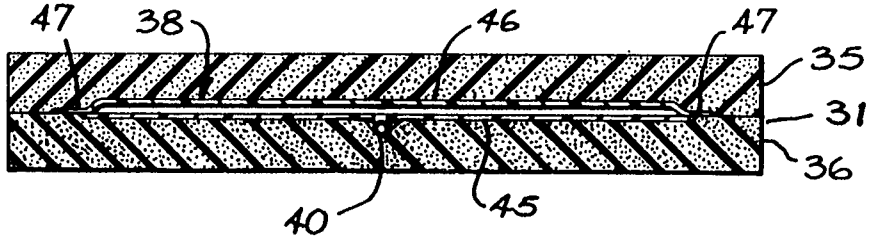
FIG. 4 is a cross-sectional view taken along lines 4—4 of FIG. 2.
Figure 3:
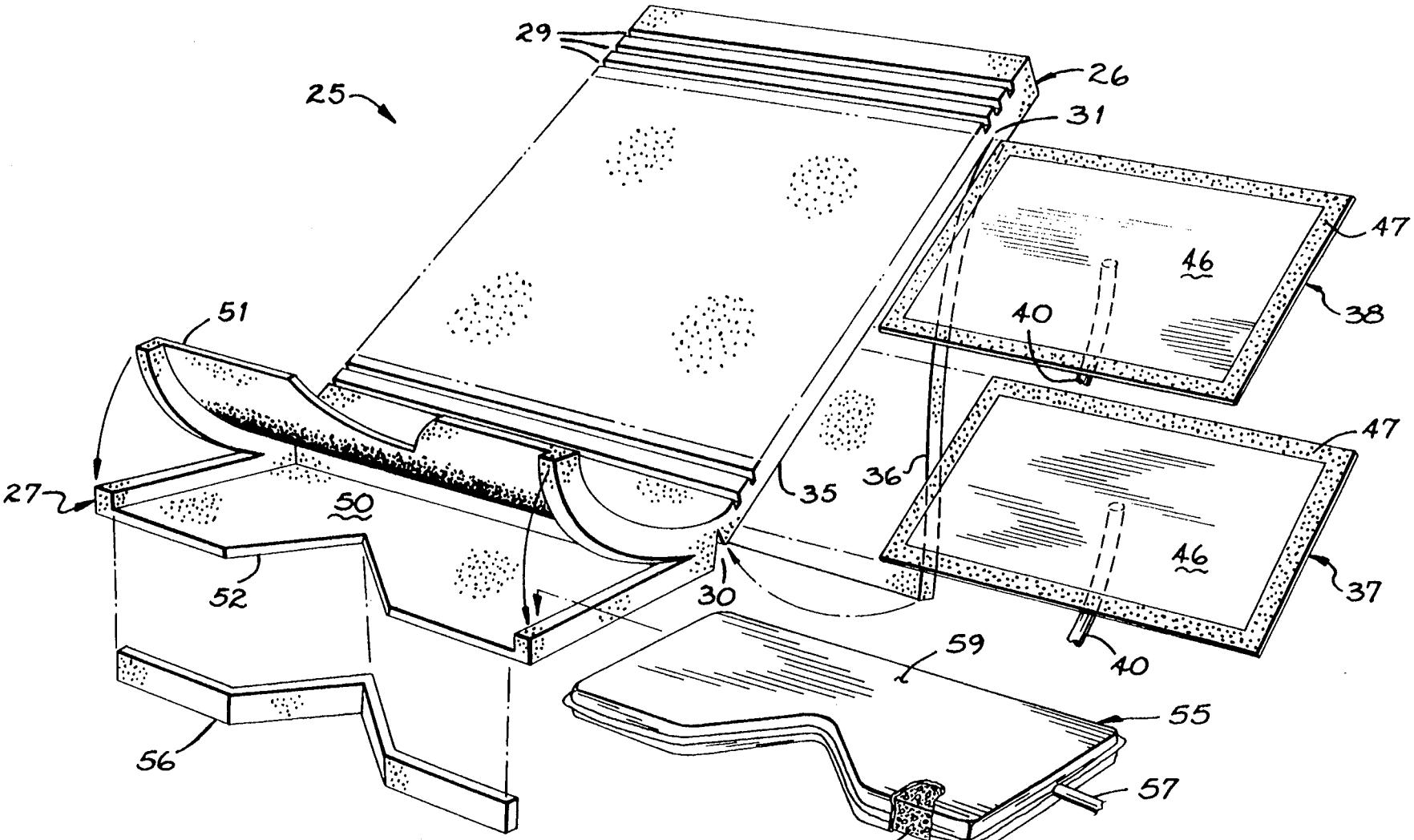
FIG. 3 is a diagrammatic disassembled perspective view of the mattress.

Each of the bladders 37, 38 is constructed and attached to the foam section 26 as shown in FIG. 4. The bladder per se is formed of a lower air-impervious ply 45 and an upper air-impervious top ply 6. The top ply 46 has a border 47 about 2 inches wide that extends completely around the perimeter of the bladder. The facing surfaces of the plies are coated with a urethane adhesive. The lower ply 45 is adhesively-bonded to the upper ply along about a $\frac{1}{4}$ to $\frac{1}{2}$ inch margin of the lower ply by dielectric, heat or resistance bonding.

The thus formed bladder is inserted into the proper position on the lower ply 36 of the foam section 26. There, the border 47, with its exposed urethane adhesive, is adhesively secured to the foam ply 36 by heat bonding. This securing of the border to the foam slab provides assurance that when inflated, the inflation will occur uniformly across the transverse dimension of the bladder and the patient will not be aware of any lopsided inflation, such as forming a bubble on one side and a bubble on the other side and then fully inflating.

The lower bladder 37 is for the lumbar region of the patient and the upper bladder 38 is for the mother's upper back and to assist her leaning forward into a C position during the labor process.

The seat section 27 of the foam slab has a cavity 50 cut out of the foam. The cavity is about two inches thick, leaving a one-inch ply of foam forming a top ply 51 and a one-inch ply of foam forming a bottom ply 52. A two-inch thick bladder 55 constructed in accordance with U.S. Pat. No. 4,624,877 which is fully incorporated herein by reference is inserted into the cavity. The cavity is enclosed by a thin V-shaped foam strap 56. A tube 57 connected to the bladder is also connected through suitable controls to the pump in a manner similar to that of the bladders 37 and 38.

The bladder 55 has a foam core 58 which is surrounded by an air-impervious cover 59. Uninflated, the bladder and mattress plies 51 and 52 provide comfortable support for the patient. However, during birth and in the process of sewing a patient following an episiotomy, the gynecologist normally prefers to have the patient on a very firm seat, permitting full exposure of the vulva, and for this purpose the bladder 55 is inflated.

In operation, the patient or the attending nurse, using controls on the side guard, will selectively inflate the bladders 37, 38 and 55. Bladder 37, the lumbar bladder, is inflated principally for the patient's comfort. The inflation process will gradually pump air into the bladder so that the bladder expands uniformly across its surface rather than bulging at one side or the other until full.

Inflation of the bladder 38 will push against the patient's upper back to assist in the patient's assumption of a C position during labor. Like the bladder 37, the bladder 38 will inflate uniformly so as to enhance the patient's sense of well being.

The mattress section overlying the seat panel will normally be fairly soft for the comfort of the patient and the patient's posterior will sink somewhat into the foam constituted by the top ply 51, the bottom ply 52 and the foam 58 in the bladder per se. However, when the gynecologist or surgeon requires a greater exposure to the patient's anatomy for either the birthing process or repairs following the birth of the baby, the bladder 55 is inflated so that there is a very firm support for the patient's posterior.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. A birthing bed comprising:

a base, a main frame mounted on said base, body support panels mounted on said main frame and including a seat panel, a head panel pivoted with respect to said seat panel and a footrest movably mounted with respect to said seat panel, a foam slab covering said seat and head panels, said seat panel including a bladder embedded in said slab which, when inflated, causes said seat to be firm, said head panel including inflatable lumbar and upper back bladders mounted in said slab, means for selectively inflating all said bladders, said head panel bladders each comprising:

a flexible plastic bladder having an approximately two-inch margin that is sealed to said slab.

2. An inflatable mattress for the seat panel of a hospital bed comprising:

upper and lower sheets of soft, flexible foam, an inflatable bladder sandwiched between said sheets, said bladder having a foam core and an air-impervious cover, means for inflating said bladder until it is substantially rigid, and a flexible cover surrounding said sandwich of sheets and bladder, whereby said seat panel mattress can be inflated to facilitate birthing procedures.

3. A mattress as in claim 2 in which a V-shaped notch is formed in an edge of said sheets and bladder facing the foot edge of the bed.

4. A mattress as in claim 2 in which said upper sheet is about 1 inch thick and in which said lower sheet is about 1 inch thick, said foam being about 4 inches thick with a 2-inch thick cavity to receive said bladder.

5. An inflatable mattress for the head panel of a hospital bed comprising:

upper and lower plies of polyurethane foam, a bladder comprising a larger ply and a smaller ply coated with adhesive on their facing surfaces, said smaller ply being adhesively secured to said larger ply around its periphery to form said bladder and to create an overhanging wide border having an exposed adhesively coated surface, said bladder being inserted between said upper and lower foam plies and heat sealed along said border to one of said foam plies, means for inflating said bladder, said wide border and foam ply combination causing said bladder to inflate uniformly across its area regardless of the position of the patient with respect to said bladder.

6. A mattress as in claim 5 in which said border is about 2 inches wide.

7. A mattress as in claim 6 in which said bladder is about 12 inches wide and 20 inches long.

8. A birthing bed comprising:

a base, a main frame mounted on said base, body support panels mounted on said main frame including a seat panel, a head panel pivoted with respect to said seat panel and a foot rest movably mounted with respect to said seat panel, a foam slab covering said seat and heat panels, inflatable bladder manes imbedded in said slab, and means for inflating said bladder means, said inflatable bladder means including a lumbar bladder and an upper back bladder in said slab over said head panel and a seat bladder in said slab over said seat panel, said lumbar and upper back bladders each comprising a flexible plastic bladder having an approximately two-inch margin sealed to said slab.

9. A birthing bed comprising:

a base, a main frame mounted on said base, body support panels mounted on said main frame and including a seat panel, a head panel pivoted with respect to said seat panel and a footrest movably mounted with respect to said seat panel, a foam slab covering said seat and head panels, an inflatable bladder mounted in said slab over said seat panel, an inflatable bladder mounted in said slab over said head panel in a lumbar area thereof, said bladder comprising a flexible plastic bladder having an approximately two-inch margin that is sealed to said slab, and means for selectively inflating said bladders.

10. An inflatable mattress for the head panel of a hospital bed comprising:

upper and lower plies of polyurethane foam, a bladder comprising a larger ply and a smaller ply, said smaller ply being adhesively secured to said larger ply to form said bladder and to create an overhanging wide border, said bladder being inserted between said upper and lower foam plies, said border being adhesively secured to one of said foam plies, and means for inflating said bladder.

11. A birthing bed comprising:

a base;

a main frame mounted on said base;

body support panels mounted on said main frame and including a seat panel, a head panel pivoted with respect to said seat panel and a foot rest movably mounted with respect to said seat panel;

a foam slab covering said seat and head panels;

an inflatable bladder mounted in said slab over said seat panel, said bladder having a foam core and an air impervious cover;

an inflatable bladder mounted in said slab over said head panel in the lumbar area thereof; and means for selectively inflating said bladders.

* * * * *